US007998044B2

(12) United States Patent
Long

(10) Patent No.: US 7,998,044 B2
(45) Date of Patent: Aug. 16, 2011

(54) COMBINED PUSH PAD AND FIXED HANDLE ACCESSORY FOR USE WITH ELLIPTICAL CROSS TRAINING EXERCISE MACHINE

(75) Inventor: Kim Long, Oconomowoc, WI (US)

(73) Assignee: Casey L. Long, Eau Claire, WI (US)

( * ) Notice: Subject to any disclaimer, the term of this patent is extended or adjusted under 35 U.S.C. 154(b) by 0 days.

(21) Appl. No.: 12/755,901

(22) Filed: Apr. 7, 2010

(65) Prior Publication Data

US 2010/0255969 A1 Oct. 7, 2010

Related U.S. Application Data

(60) Provisional application No. 61/167,187, filed on Apr. 7, 2009.

(51) Int. Cl.
*A63B 26/00* (2006.01)

(52) U.S. Cl. ..... 482/141

(58) Field of Classification Search ..... 482/148, 482/51–54, 92–96, 139, 126
See application file for complete search history.

(56) References Cited

U.S. PATENT DOCUMENTS

| | | | | |
|---|---|---|---|---|
| 1,548,849 | A | 8/1925 | Ruden | |
| 2,521,649 | A | 9/1950 | Paupa | |
| 4,508,341 | A | 4/1985 | Carrington | |
| 4,614,338 | A | 9/1986 | Castillo | |
| 4,720,103 | A | 1/1988 | Palladino, Jr. | |
| 4,836,531 | A | 6/1989 | Niks | |
| 5,143,372 | A | 9/1992 | Wilson | |
| 5,755,652 | A | 5/1998 | Gardner | |
| 6,500,099 | B1 * | 12/2002 | Eschenbach | 482/57 |
| 7,172,535 | B2 | 2/2007 | Volmar | |
| 2010/0197466 | A1 * | 8/2010 | Kuo | 482/52 |
| 2010/0216616 | A1 * | 8/2010 | Jennings | 482/142 |

* cited by examiner

*Primary Examiner* — Lori Baker
(74) *Attorney, Agent, or Firm* — Joseph S. Heino; Patrick M. Bergin

(57) ABSTRACT

An accessory device for use with an elliptical cross training machine comprises two like-configured attachments, each of with generally comprises a handle attachment bracket, a substantially horizontal stabilizer bar, a combined palm push pad/handle attachment bracket, a fixed handle, and a push palm pad. The fixed handle and the palm pad are fully and rotatably movable around and about the stabilizer bar. Each is also longitudinally movable along the stabilizer bar to provide inward and outward movement of the fixed handle and the push palm pad relative to the original handle positions of the elliptical cross trainer to which they are attached. The accessory device allows the user to have a combined platform to push from, in a form that is similar to doing a push up from the floor, as well as a fixed point handle that presents to the user at a more natural shoulder angle.

12 Claims, 7 Drawing Sheets

COMBINED PUSH PAD AND FIXED HANDLE ACCESSORY FOR USE WITH ELLIPTICAL CROSS TRAINING EXERCISE MACHINE

This application claims the benefit and priority of United States Provisional Patent Application No. 61/167,187 filed Apr. 7, 2009.

FIELD OF THE INVENTION

The present invention relates generally to exercise machines and equipment, the component parts that are used in such machines and equipment, and to the various accessories that can be used with such machines and equipment. More particularly, it relates to an accessory device that can be used with elliptical cross training machines, or "elliptical cross trainers," of the type that incorporate leg exercise for simulating walking, jogging and climbing, and that also incorporate arm exercise for simulating push-ups and the like.

BACKGROUND OF THE INVENTION

Elliptical cross training exercise machines, or "elliptical cross trainers" as they are more often referred to in the industry, are a type of exercise equipment that guide the user's feet along a generally elliptical-shaped curve to simulate the motions of jogging and climbing. Two foot pedals are used to accomplish these motions. Two handles are, in turn, connected to the pedals, the handles being moveable generally forwardly and rearwardly, in parallel motion and one handle to each side of the user's torso. Relative to the user's body, however, it is known that the handles are in a relatively "fixed" position.

One limitation of this fixed positioning is that the average distance between the two handles is typically too wide for many users, particularly women, de-conditioned individuals and older individuals. In the experience of this inventor, this distance causes each of the shoulders of such individuals to be engaged at a contra-indicated angle, thereby over-utilizing the small muscle group commonly referred to as the "rotator cuff." The rotator cuff is not a single muscle. In actuality, it is a number of smaller muscles that work together to stabilize the shoulder. The contra-indicated angle mentioned above, and the motion that results from it, may or may not cause an immediate injury and many times does not. Over time, however, this action is known by this inventor to cause small micro-tears in any number of the smaller muscles resulting in acute swelling and severe pain. Also, because of the acute angle, it is not uncommon for tendinitis to flare at the muscle insertion points.

Accordingly, it is desirable that an accessory device be conceived that effectively brings the handles of an elliptical cross trainer closer together. It is also desirable to devise such an accessory device that would provide quick and simple adjustability for accommodating a wide variety of user sizes. It is further desirable to construct such an accessory device such that a combined platform to push from, in a form that would be similar to doing a push up from the floor, is presented together with a fixed point handle that presents at a more natural shoulder angle. In this fashion, the combined push pad/fixed handle accessory device would work to isolate the pectoral major muscle and the pectoral minor muscle during the concentric motion of the handle movement of the elliptical cross trainer. This would allow for ease of motion and less shoulder involvement from an otherwise contra-indicated angle, which would be eliminated by use of the accessory device. Additionally, and from the improved position provided through the use of the accessory device, the user of the elliptical cross trainer could work more comfortably. That is, a larger muscle group would be utilized as the "primary" mover and more calories would be burned, together with a higher level of VO2 max (maximum volume of oxygen consumed per unit of time) would be realized. Because of the limited angle from either the push pad or the fixed handle, this accessory device could be adapted for use in a shoulder or cardio rehabilitation situation. Each of the foregoing is an objective of the present invention.

SUMMARY OF THE INVENTION

In the accessory device of the present invention, structural elements are provided that allow the user of the elliptical cross trainer to bring his or her hands and arms into a position that prevents the contra-indicated angle and over-utilization of the rotator cuff as mentioned above. Specifically, the accessory includes two like-configured attachment devices, each of with generally comprises a handle attachment bracket, a substantially horizontal stabilizer bar, a combined palm push pad/handle attachment bracket, a fixed handle, and a push palm pad. The handle attachment bracket is vertically movable and positionable along the length of the handle of the elliptical cross trainer to accommodate the height of the user. The fixed handle and the palm pad are fully and rotatably movable around and about the stabilizer bar. Each is also longitudinally movable and variably positionable and fixable along the stabilizer bar to provide inward and outward movement of the fixed handle and the push palm pad relative to the original handle positions of the elliptical cross trainer to which they are attached. This functionality serves to accommodate users having various shoulder widths. This accessory device allows the user to have a combined platform to push from, in a form that is similar to doing a push up from the floor, as well as a fixed point handle that presents to the user at a more natural shoulder angle.

The foregoing and other features of the accessory device of the present invention will be apparent from the following detailed description when read in conjunction with the accompanying drawings.

BRIEF DESCRIPTION OF THE DRAWINGS

FIG. 1 is a top, rear and left side perspective view of a typical elliptical cross training machine of the type that the accessory device of the present invention is used with.

DETAILED DESCRIPTION

Figure 1:
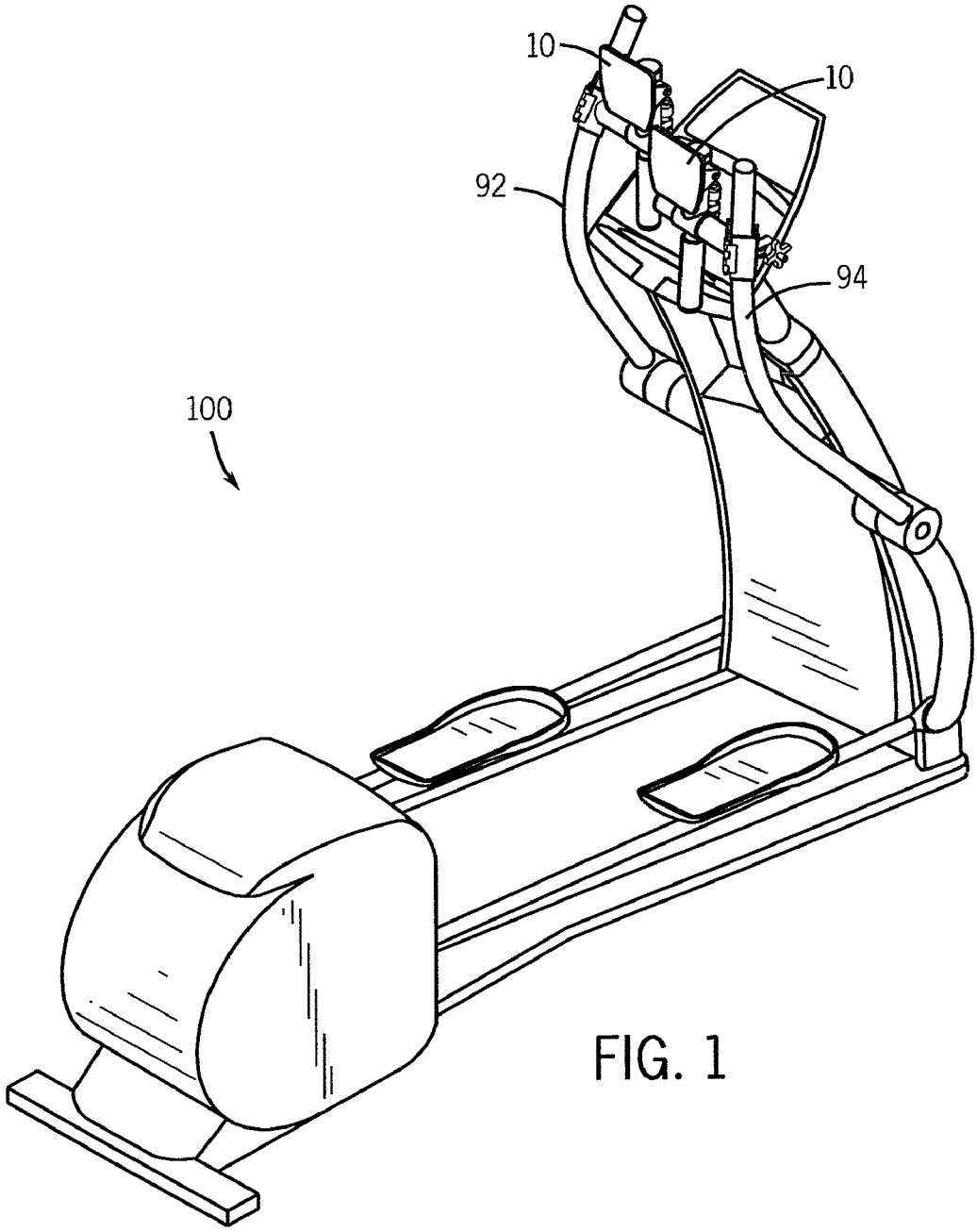

Referring now to the drawings in detail, wherein like-numbered elements refer to like elements throughout, FIG. 1 illustrates one embodiment of an elliptical cross trainer, designated generally by the numeral 100. As shown, the trainer 100 includes a pair of handles 92, 94. In application, the user would move the handles 92, 94 alternatively forwardly and backwardly, in cadence with the user's concentric stepping motion. It is to be understood that the type of elliptical cross trainer 100 that the device of the present invention may be used with is not limited to the specific type shown in FIG. 1 as any number of such trainers would allow for proper usage of such device as will be apparent in the following description.

Figure 2:
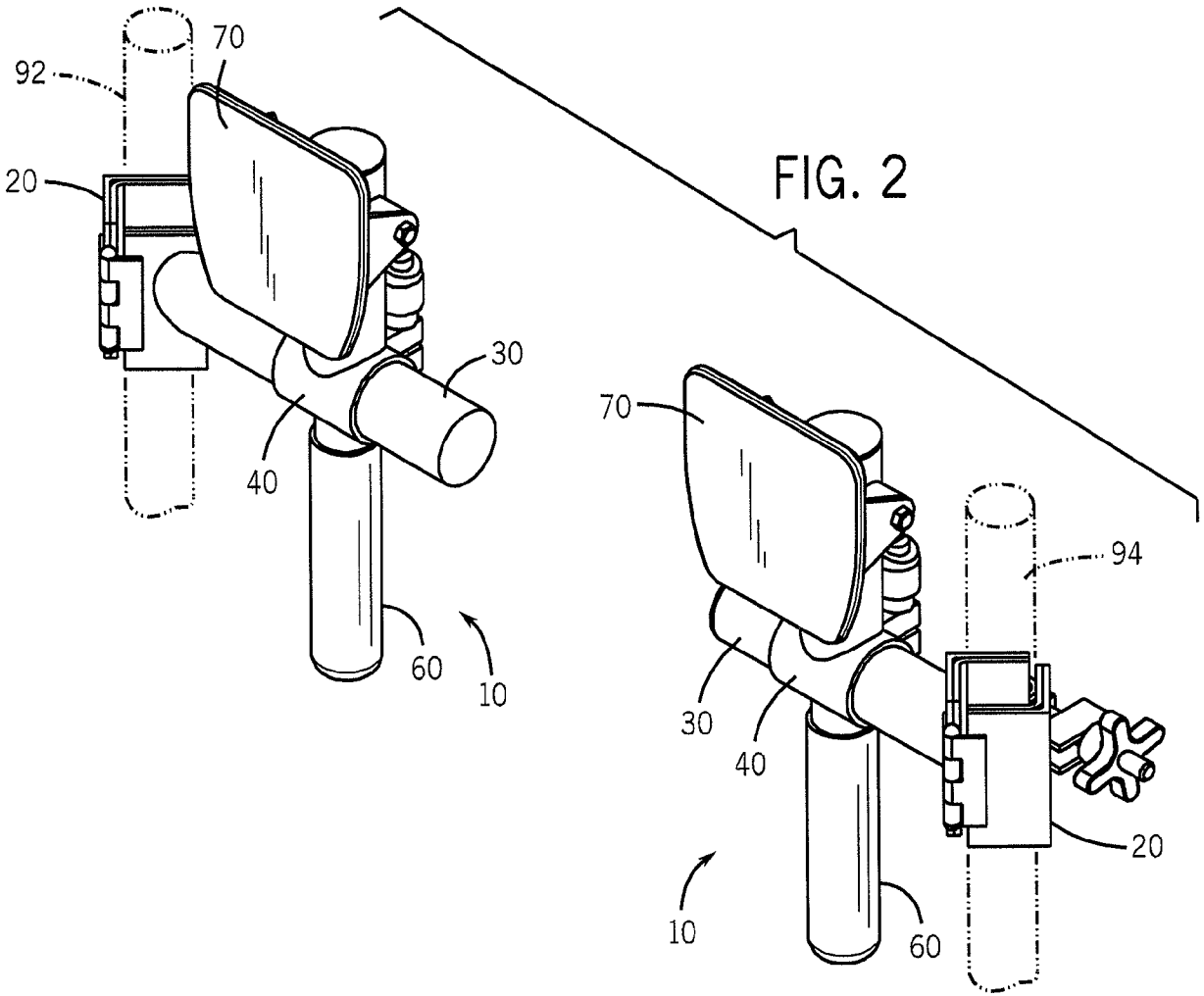
FIG. 2 is a top, rear and left side perspective view of the accessory devices of the present invention as they would be attached to a pair of handles of the elliptical cross training machine shown in FIG. 1, with the upright tubular handles being illustrated in phantom view.
Figure 3:
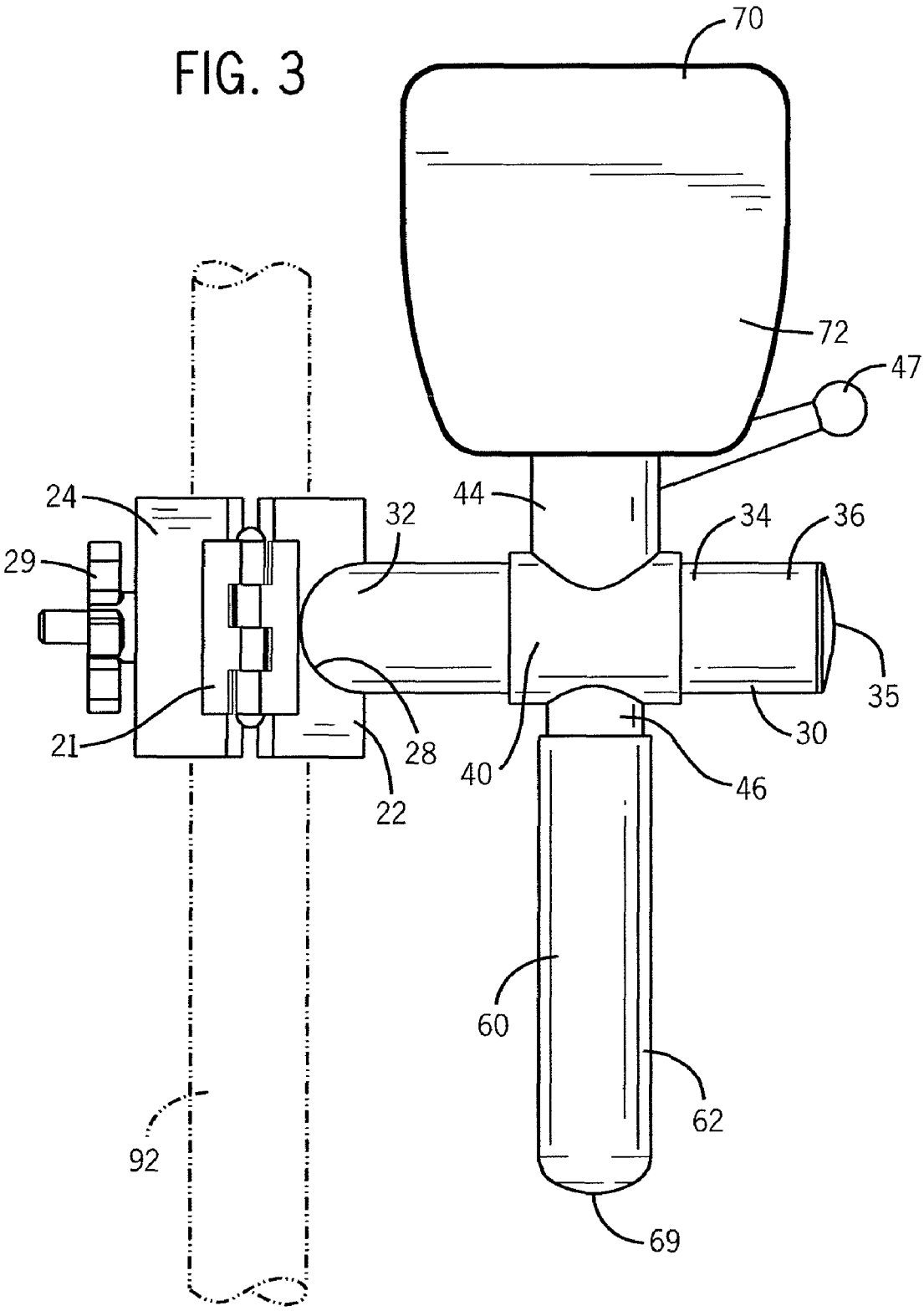
FIG. 3 is an enlarged and rear elevational view of one of the accessory devices shown attached to that handle of the elliptical cross training machine illustrated in FIG. 1 which would be to the user's left during use.
Figure 4:
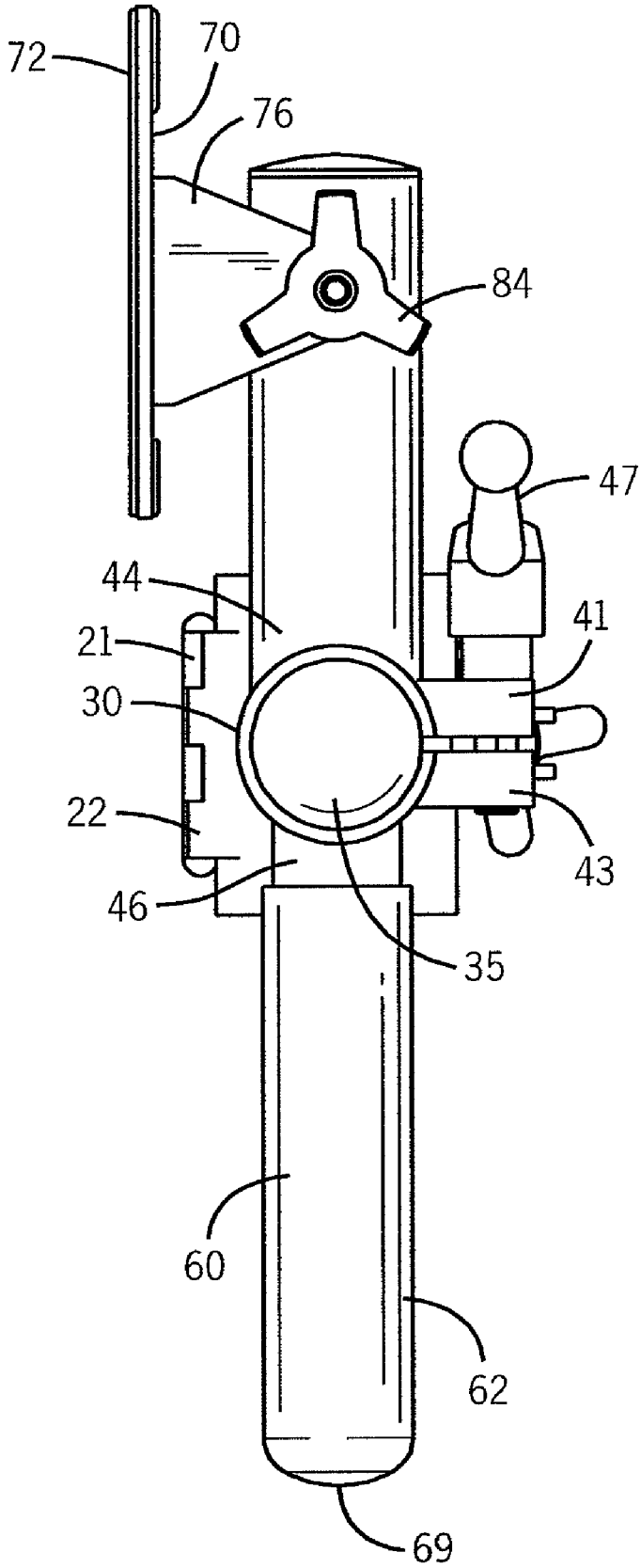
FIG. 4 is a left side elevational view of the accessory device illustrated in FIG. 3.

Referring now to FIG. 2, a pair of accessory devices that are constructed in accordance with the present invention is shown, each accessory device being designated generally by the numeral 10 and each device 10 being used in tandem with the other. As shown, the device 10 comprises several key elements. Specifically, the device 10 comprises a handle attachment bracket, generally identified 20, a stabilizer bar 30, and a combined push pad/handle attachment bracket 40. Generally, the handle attachment bracket 20 is used to affix the device 10 to an upright handle 92, 94 of an elliptical cross trainer 100 of the type shown in FIG. 1. The stabilizer bar 30 extends generally inwardly from the handle 92, 94 that it is attached to. Additionally, the combined push pad/handle attachment bracket 40 has a fixed handle 60 disposed to one side of it. Disposed opposite the fixed handle 60 is a palm push pad 70.

The handle attachment bracket 20 includes, in a first preferred embodiment, an attachment means that generally comprises an inner attachment bracket portion 22 and an outer attachment bracket portion 24, each bracket portion 22, 24 being disposed to the outer surface of the handle 92 to which it would be attached. See FIG. 3. It is to be understood, however, that each accessory device 10 comprises the same elements, although only one such device 10 is illustrated in FIGS. 3 through 7.

Figure 5:
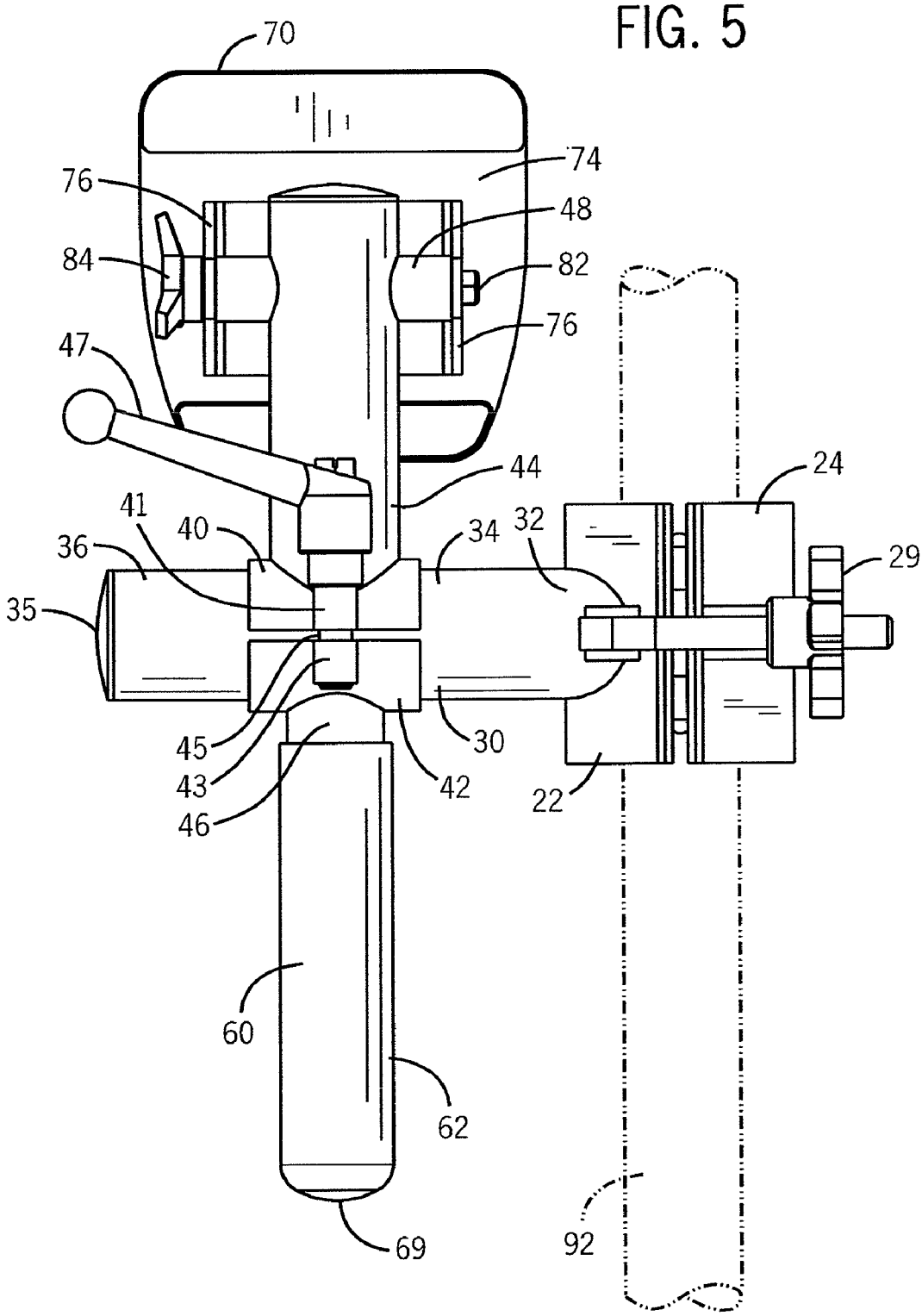
FIG. 5 is a front elevational view of the accessory device illustrated in FIGS. 3 and 4.
Figure 6:
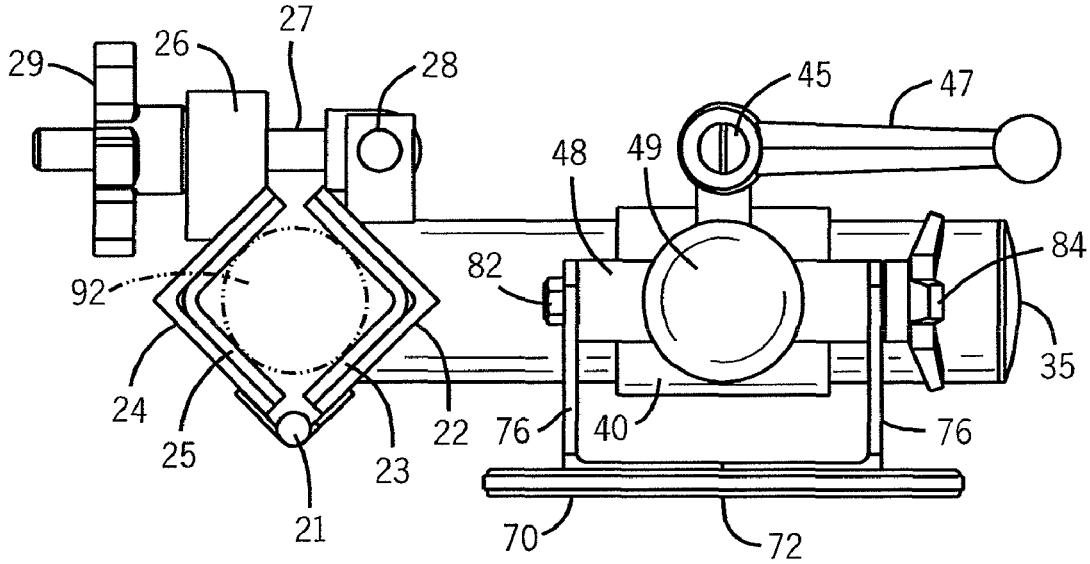
FIG. 6 is a top plan view of the accessory device illustrated in FIGS. 3 through 5.

The handle attachment bracket 20 also includes a hinge means 21, the hinge means 21 being common to one side of each bracket portion 22, 24. Again, see FIG. 3. As shown in FIGS. 5 and 6, it will be seen that the handle attachment bracket 20 also includes a securing means comprising, in the preferred embodiment, a generally U-shaped first securement receiver 26 that is fixedly attached to the outer attachment bracket portion 24 and a second securement receiver 28 that is fixedly attached to the inner attachment bracket portion 22. Rotatably captured within the second receiver 28 is one end of a securement bolt 27, the opposite end being threaded and having a like-threaded knob 29 that is rotatable about it to secure the bracket 20 to the handle 92.

Finally, the bracket 20 includes a cushioning means 23, 25 for each bracket portion 22, 24, respectively. The securing means could comprise other tightening and un-tightening mechanisms for removably securing the accessory device 10 to either handle 92, 94. In this fashion, the device 10 can be quickly and easily positioned and re-positioned along the length of the handle 92, 94, depending upon the setting desired or required by the particular user of the elliptical cross trainer 100. The handle attachment bracket 20, or portions of it, could be fabricated from a metal, plastic, carbon fiber, or other material, and such is not a limitation of the present invention.

The stabilizer bar 30 is, in the preferred embodiment, a substantially tubular metal structure having a proximal portion 32, a medial portion 34 and a distal portion 36. See FIGS. 3 and 5. Although the bar 30 is preferably a tubular metal structure, it too could be fabricated from plastic, carbon fiber, or other suitable materials and such is not a limitation of the present invention. The bar 30 could also be fabricated as a structure that is solid instead of tubular. Being tubular, however, reduces the overall weight of the device 10 and is a design choice or expediency. The proximal portion 32 of the stabilizer bar 30 is attached to the handle attachment bracket 20 at a point 28. The distal portion 36 of the stabilizer bar 30 can include an end-cap 35 to prevent the user from being exposed to any sharp edge along the distal portion 36.

The combined push pad/fixed handle attachment bracket 40 comprises a rotatable and substantially C-shaped central bracket portion 42 the purpose of which is to allow the push pad/fixed handle attachment bracket 40 to rotate about the tubular stabilizer bar 30 as well as to move along its length to any point that lies between the proximal portion 32 and the distal portion 36 of that bar 30. See FIG. 4. This range of positioning is intended to accommodate any number of differently-sized users of the elliptical cross trainer 100. It is also to be understood that the bracket 40 includes securement means for quickly and easily affixing the bracket 40 in any number of positions along the stabilizer bar 30. In the preferred embodiment, the securement means comprises a first bracket portion 41 and a second bracket portion 43, the first and second bracket portions 41, 43 being positionally secured by means of a connector 45 having a quick-release camming action by means of a lever 47. See FIGS. 4, 5 and 6, in particular. It is to be understood that the securement means could be alternatively configured within the scope of the present invention. Similarly, it is to be understood that the material that the combined push pad/fixed handle attachment bracket 40 is fabricated from is not a limitation of the present invention.

The bracket 40 includes a first extension member 44 and a second extension member 46, the first and second extension members 44, 46 being substantially co-linear, the purpose of which will be apparent later in this detailed description. Again, see FIGS. 3, 4 and 5. The first and second extension members 44, 46, in the preferred embodiment, are each a substantially tubular structure, but need not be. The extension members 44, 46 could also be fabricated as structures that are solid instead of tubular. As was true of the stabilizer bar 30, the extension members 44, 46, or one of them, being tubular can result in the reduction of the overall weight of the device 10 as a design choice.

The first extension member 44 of the push pad/fixed handle attachment bracket 40 includes a transverse member 48 and an end cap 49. See FIG. 6. The second extension member 46 of the push pad/fixed handle attachment bracket 40 comprises a fixed handle 60 that includes, in the preferred embodiment, a padded handle portion 62 and an end cap 65. The type of padding that is used in the padded handle portion 62 is not a limitation of the present invention. Additionally, it may be desirable to integrally form the handle portion 62 and end cap 69 as a single structure. As alluded to earlier, this fixed handle 60 is disposed 180° opposite the first extension member 44 of the bracket 40 mentioned above. In application, the fixed handle 60 substitutes for that portion of the handle 92, 94 of the elliptical cross trainer 100 that the user would normally use when using the trainer 100 without the accessory device 10.

The palm push pad 70 comprises a front face 72 and a back face 74. Extending rearwardly from the back face 74 is a pair of attachment members 76. See FIGS. 3 through 6. A hole (not shown) is defined within each of the attachment members 76 to accommodate a retention member in the form of a retaining pin 82 that extends through the transverse member 48 and a hole (not shown) that is defined within it as well as a hole (also not shown) that is defined in the first extension member 44 of the bracket 40. This configuration allows the palm push pad 70 to rotate about the retaining pin 82 to simulate the movement made during a push up but also providing a device that does not stress the user's wrists during use. A knob 84 is also provided for securement of the pad position if such is desired or required. See FIG. 4. It is to be understood that the palm push pad 70 and its various component parts as described herein may be fabricated of metal, plastic, carbon fiber, or any number of other materials, such not being a limitation of the present invention. It would also be possible to include a cushioning or non-slip material (not shown) to the front face 72 of the pad 70 for added comfort and safety for the user.

Although the foregoing accessory device 10 and its component parts have been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

In application, the user would open a handle attachment bracket 20 by spreading the hinged bracket portions 22, 24 apart, placing the bracket 20 around a handle 92, 94, one to each of the two handles 92, 94 of the elliptical trainer 100. The user would then adjust the height of the accessory device 10 such that it is disposed in a suitable vertical position for the user's comfort. Once the device 10 is properly aligned in the vertical position, the handle attachment bracket 20 can be secured in that vertical position by the locking or securement means. In the preferred embodiment, that is accomplished by rotating the bolt 27 about the second receiver 28 and into the U-shaped first receiver 26 and then rotating the knob 29 to tighten the knob 29 against the first receiver 26. It is to be understood that the same positioning is accomplished with the second accessory device 10 that is used in parallel with the first device 10.

The user would then loosen the palm push pad/fixed handle attachment bracket 40 by rotating the lever 47 to loosen the C-shaped central bracket portion 42 and then moving it longitudinally along the stabilizer bar 30 such that the user would be in a position to comfortably and properly use either the palm push pad 70 or the fixed handle 60 of the accessory device 10. The lever 47 is then rotated back to a tightening position. It is to be understood that the same positioning is accomplished with the second accessory device 10 that is used in parallel with the first device 10.

Figure 7:
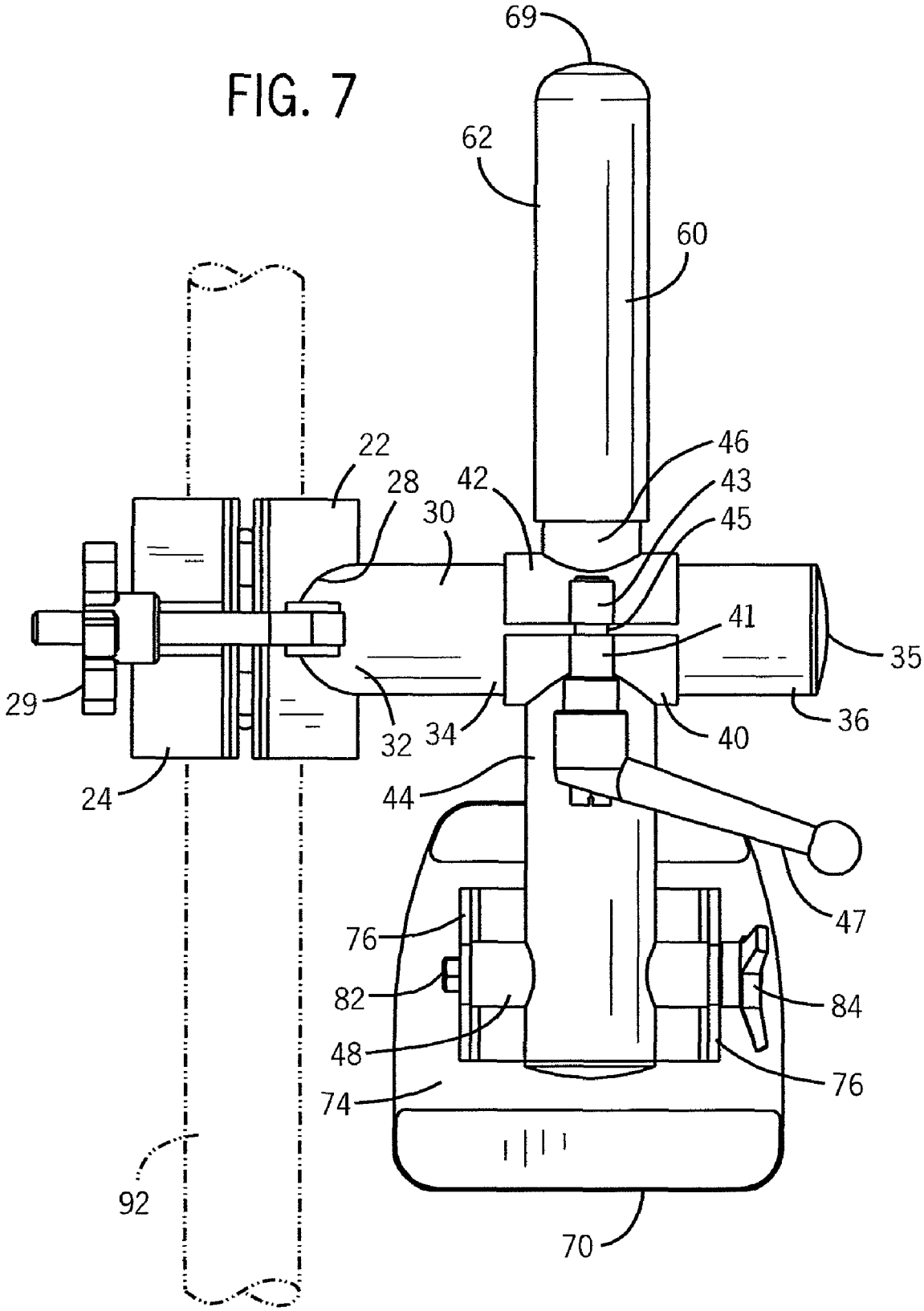
FIG. 7 is a rear elevational view of the accessory device illustrated in FIG. 3 after a portion of the device has been rotated 180° .

Once both of the accessory devices 10 are in position, and the user has determined the proper vertical and horizontal positioning of the handle attachment bracket 20 and the palm push pad/fixed handle attachment bracket 40, respectively, the user can rotate the fixed handle 60 and the palm pad 70 about the stabilizer bar 30 in such a way that the fixed handle 60 is facing upwardly or downwardly, and in the same way with the palm push pad 70. See, for comparison, FIGS. 3 and 7. FIG. 7 shows the fixed handle 60 facing upwardly. This rotation is also effected by use of the lever 47 in conjunction with the bracket 40. As the user begins the process of exercising on the elliptical trainer 100, the fixed handle 60 is used to replace the normal hand position on the handles 92, 94. If the user wants to utilize the elliptical trainer 100 in such a way that he or she is simulating a "push up" action, then the palm pad 70 would be rotated along the stabilizer bar and fastened into place by means of the palm push pad/fixed handle attachment bracket 40 and lever 47 so that the user can put the palm of his or her hand along the front face 72 of the palm pad 70. See FIG. 3. In that position, the palm pad 70 will be allowed to rotate about the pivot point 82 and simulate the action of a floor push up as previously described.

The details of the invention having been disclosed in accordance with the foregoing, I claim:

1. An accessory device in combination with an elliptical cross training machine, the machine comprising a pair of movable upright handles positioned one forwardly and one to each side of a user, the handles further being positioned a distance from one another, the device comprising:

a handle attachment bracket for each handle of the machine;

a stabilizer bar for each attachment bracket; and a combined push pad/handle attachment bracket for each stabilizer bar;

wherein the handle attachment bracket comprises an inner bracket portion and an outer bracket portion, each bracket portion being disposed to an outer surface of the handle to which it is attached.

2. The accessory device of claim 1 wherein the handle attachment bracket further comprises means for securing the device at different positions along the upright handle.

3. The accessory device of claim 1 wherein the stabilizer bar comprises a proximal portion, a medial portion and a distal portion, the proximal portion being attached to the inner bracket portion of the handle attachment bracket.

4. The accessory device of claim 3 wherein the combined push pad/fixed handle attachment bracket is rotatable about the stabilizer bar.

5. The accessory device of claim 4 wherein the combined push pad/fixed handle attachment bracket comprises a first extension member and a second extension member, the first and second extension members being substantially collinear.

6. The accessory device of claim 5 wherein the first extension member of the push pad/fixed handle attachment bracket comprises a transverse member.

7. The accessory device of claim 5 wherein the second extension member of the push pad/fixed handle attachment bracket comprises a padded handle portion.

8. The accessory device of claim 6 wherein the first extension member of the push pad/fixed handle attachment bracket further comprises a palm push pad.

9. The accessory device of claim 8 wherein the palm push pad comprises a front face, a back face and a pair of attachment members extending from the back face.

10. The accessory device of claim 9 wherein each attachment member comprises a hole and wherein the device further comprises a retention member that extends through the transverse member and the holes of the attachment members.

11. The accessory device of claim 9 wherein the front face of the palm push pad comprises a cushioning material.

12. The accessory device of claim 9 wherein the front face of the palm push pad comprises a non-slip material.

* * * * *